US007404345B1

(12) United States Patent
Dipprey

(10) Patent No.: US 7,404,345 B1
(45) Date of Patent: Jul. 29, 2008

(54) COMBINATION BOTTLE/CAN BEVERAGE COOLER AND BOTTLE CAP OPENER

(75) Inventor: Gary Dipprey, Dallas, TX (US)

(73) Assignee: Calibre International, LLC, Irwindale, CA (US)

( * ) Notice: Subject to any disclaimer, the term of this patent is extended or adjusted under 35 U.S.C. 154(b) by 0 days.

(21) Appl. No.: 11/726,974

(22) Filed: Mar. 23, 2007

Related U.S. Application Data

(60) Provisional application No. 60/767,477, filed on Mar. 31, 2006.

(51) Int. Cl.
*B67B 7/44* (2006.01)

(52) U.S. Cl. ..... 81/3.09

(58) Field of Classification Search ..... 81/3.07, 81/3.09, 3.15

See application file for complete search history.

(56) References Cited

U.S. PATENT DOCUMENTS

| | | | | |
|---|---|---|---|---|
| 937,850 | A | 10/1909 | Parker | |
| 1,755,086 | A | 4/1930 | Tapp | |
| 1,810,630 | A | 6/1931 | Tapp | |
| 2,745,301 | A | 5/1956 | Grunwald | |
| 3,236,126 | A | 2/1966 | Martinmaas | |
| 4,798,300 | A | 1/1989 | Ghosh et al. | |
| 4,829,618 | A | 5/1989 | McKee | |
| D367,413 | S | 2/1996 | Ballin | |
| D388,660 | S | 1/1998 | Grundl | |
| 6,062,380 | A | 5/2000 | Dorney | |
| 6,550,271 | B2 | 4/2003 | Silberg | |
| D506,910 | S | 7/2005 | Tham-itthisak | |
| 2002/0175169 | A1 | 11/2002 | Tham-itthisak | |
| 2006/0016294 | A1 | 1/2006 | McGrath et al. | |
| 2007/0012140 | A1 * | 1/2007 | Howlett et al. | 81/3.09 |

* cited by examiner

*Primary Examiner*—David B Thomas
(74) *Attorney, Agent, or Firm*—Thomas I. Rozsa

(57) ABSTRACT

A combination bottle/can beverage cooler and bottle cap opener, which is comprised of a thermal insulated holder having an inner layer and outer layer to serve as a cooler for a beverage bottle/can, wherein the bottom of the inner layer is comprised of a double bottle cap opening means. With the aid of the double cap opening means, the cap of a beverage bottle can be conveniently twisted off or pried off. The opened beverage bottle/can then can be placed inside of the holder to keep the beverage cold and the users' hands from getting wet or cold.

20 Claims, 4 Drawing Sheets

COMBINATION BOTTLE/CAN BEVERAGE COOLER AND BOTTLE CAP OPENER

This application claims benefit of application Ser. No. 60/767,477 filed Mar. 31, 2006.

BACKGROUND OF THE INVENTION

1. Field of the Invention

The present invention is related to the field of containers and coolers which are used to hold a beverage can or bottle and also to devices which are used to open a bottle cap.

2. Description of the Prior Art

Beverage container coolers and bottle cap openers are well known in the prior art. The following 14 patents and published patent applications are the closest prior art references which are related to the present invention.

1. U.S. Pat. No. 937,850 issued to Edmund A. Parker on Oct. 26, 1909 for "Coaster And Bottle Opener" (hereafter the Parker patent");

2. U.S. Pat. No. 1,755,086 issued to Charles Ernest Tapp on Apr. 15, 1930 for "Combination Tumbler And Bottle Opener" (hereafter the "'086 Tapp patent");

3. U.S. Pat. No. 1,810,630 issued to Charles Ernest Tapp on Jun. 16, 1931 for "Combination Container And Bottle Opener" (hereafter the "'630 Tapp patent");

4. U.S. Pat. No. 2,745,301 issued to Edward Grunwald on May 15, 1956 for "Cap Remover And Bottle Opener For Bottles And Cans" (hereafter the "Grunwald patent");

5. U.S. Pat. No. 3,236,126 issued to Werner W. Martinmaas and assigned to The Future Bottle Corp. on Feb. 22, 1966 for "Beverage Container With Integral Crown Cap Remover" (hereafter the "Martinmaas patent");

6. U.S. Pat. No. 4,798,300 issued to Asim Ghosh et al. and assigned to Carling O'Keefe Breweries of Canada Limited on Jan. 17, 1989 for "Bottle With Integral Cap-Removing Recess" (hereafter the "Ghosh patent");

7. U.S. Pat. No. 4,829,618 issued to Carl B. McKee on May 16, 1989 for "Coaster/Opener For Beverage Containers" (hereafter the "McKee patent");

8. U.S. Pat. No. 6,550,271 issued to Curt Edward Silbert on Apr. 22, 2003 for "Neoprene Bottle Insulator" (hereafter the "Silbert patent");

9. U.S. Design Pat. No. Des. 367,413 issued to Scott Ballin on Feb. 27, 1996 for "Combined Shot Glass And Bottle Opener" (hereafter the "Ballin Design patent");

10. U.S. Design Pat. No. Des. 388,660 issued to Harald Gründl and assigned to Bergmann, Bohmann, Gründl—Design GmbH on Jan. 6, 1998 for "Drinking Cup With Cover And Opener For Beverage Tins" (hereafter the "Gründl Design patent");

11. U.S. Pat. No. 6,062,380 issued to Peter Dorney on May 16, 2000 for "Glow Cup System" (hereafter the "Dorney patent");

12. United States Published Patent Application No. 2002/0175169 issued to Khetrat Tham-itthisak on Nov. 28, 2002 for "Drinking Glass With Integral Bottle Opener" (hereafter the "Tham-itthisak Published patent application");

13. U.S. Design Pat. No. D506,910 issued to Khetrat Tham-itthisak on Jul. 5, 2005 for "Glass Bottle Opener" (hereafter the "Tham-itthisak Design patent");

14. United States Published Patent Application No. 2006/0016294 issued to Michael W. McGrath et al. on Jan. 26, 2006 for "Temperature Insulated Beverage Container Receptacle And Opening Apparatus" (hereafter the "McGrath Published patent application");

The Parker patent discloses a combination of a coaster and a bottle cap opener. This invention discloses the concept of having a bottle which can sit on the coasters and alternatively turning over a portion of the coaster so that it can be used as a bottle cap opener.

The '086 Tapp patent discloses the combination of a tumbler and a bottle cap opener incorporated into the side wall of the tumbler.

The '630 Tapp patent is a combination container having a bottle cap opener in the bottom wall of the container by which the bottle cap can be removed in a crown removing method as discussed in the patent.

The Grunwald patent is a combination of having a bottle cap remover either formed into the bottom of a bottle or having a can or a container into which the bottle is placed. Therefore, this patent also discloses the concept of having a container in which the bottle can be placed and having a bottle cap remover in the container.

The Martinmaas patent discloses a beverage container which has built into the bottom wall a cap removing means which can be used to remove a crown cap from a bottle, wherein the cap removing means is formed in the exterior of the bottom surface.

The Ghosh patent discloses a bottle having a bottle remover formed into the bottom surface of the bottle with a twist-off type removing mechanism. Therefore, one bottle can be placed underneath a second bottle and then the bottle on top can be twisted to remove a twist-off bottle cap.

The McKee patent discloses a coaster onto which a can or bottle can be placed and has means on the bottom of the coaster so that the bottle cap can be twisted off. There is also a mechanism to enable a pop top can to be opened. This invention discloses the concept of having a twist-off bottle opener in the bottle extending from the outward bottom surface of the coaster.

The Silbert patent is a combination neoprene bottle insulator which has a thermally insulated beverage bottle holder having a detachable carrying strap and a bottle opener and a bottle cap.

The Ballin patent is a design patent which discloses a combined shot glass and bottle opener. The bottle opener is placed in the bottom of the shot glass which is more of a crown as opposed to a twist-off type bottle opener so that the bottle can be opened from the bottom of the shot glass and the liquor poured in.

The Gründl patent is also a design patent which discloses a drinking cup with a cover and a sharp opener for beverage tins.

The Dorney patent discloses a glow cup system. The primary function of the device is to have a phosphorescent glowing mechanism by which the cup can be seen in the dark. The invention also discloses a twist-off bottle opener with teeth incorporated into the bottom of the container so that it can be used to twist-off a bottle cap.

The Tham-itthisak Published patent application discloses a drinking glass with integral bottle opener, which is more of a crown type bottle opening device. The drinking glass has beverage retaining section. The outer surface of the closed end includes a bottle opener formed therein. The bottle opener is positioned in the drinking glass such that a bottle can be opened with the drinking glass while the drinking glass contains liquid without spilling the liquid in the glass or in the bottle.

The Tham-itthisak Design patent is essentially the same device as shown in the previous published patent application.

The McGrath Published patent application discloses a temperature insulated beverage container receptacle and opening apparatus. In this case the device includes a twist-off mechanism to twist-off a bottle cap. The bottom also contains a second cavity so that the device can be used to remove a crown type bottle cap. Therefore, this published patent application discloses the concept of having side-by-side twist-off and crown cap opening features.

There is significant need to provide a holder which can serve as a combination bottle/can beverage cooler and bottle cap opener.

SUMMARY OF THE INVENTION

The present invention is a combination bottle/can beverage cooler and bottle cap opener, comprising a thermal insulated holder having an inner layer and outer layer which serves as a cooler for a beverage bottle/can, wherein the bottom of the inner layer is comprised of a double bottle cap opening means including a twist-off cap opener and pry-off cap opener. In a preferred embodiment, the holder is comprised of a plurality of circularly arcuate sections which are connected in order to form a cup-like means.

The twist-off cap opener is comprised of an inwardly extending teeth support circular wall to surround a round cavity, which is positioned at the center of an inner surface of the bottom member of the inner layer The circular wall includes a circular inner side surface which defines a diameter to match the diameter of a twist-off cap of a beverage bottle. The circular side surface of the teeth support circular wall also circumferentially contains teeth means, which enhances engagement to the side surface of the a twist-off bottle cap when the cap of the beverage bottle is inserted into the round void of the twist-off cap remover.

The pry-off cap opener is comprised of a rectangular opening throughout the bottom member of the holder inner layer, which is positioned along a diameter of the round void of the twist-off opener. The pry-off opener is further comprised of a contoured lip positioned on the inner surface of the bottom member of the inner layer along each elongated side of the rectangular opening, wherein the lip is contoured in such way as to allow a part of the crown bottle cap to slide into the rectangular opening so that the edge of the crown cap securely rests on the contoured lip.

With the aid of the double bottle cap opening means, the cap of a beverage bottle can be conveniently twisted off or pried off. The opened beverage bottle/can then can be placed inside of the holder to keep the beverage cold and the users' hands from getting wet or cold.

The present invention is an insulated bottle/can cooler. The devices holds a bottle or a can in an insulated container that keeps the beverage cold and protects the user's hands from getting wet or cold. The bottle/can cooler is made of two layers. The exterior layer is constructed of a soft and flexible plastic-like or cloth-like material. This material conceals an interior lining constructed of a heavy-duty PVC or other plastic-like material. There are two construction options for the interior lining. Option one allows for the durable liner to cover only the base and approximately 1 inch of the interior wall. Option two allows for the entire cooler's interior to be lined with the durable plastic insulation.

The device further comprises an exterior crown bottle cap opener and an interior twist-off bottle cap opener. The device respectively removes crown bottle caps and twist-off bottle caps.

It is therefore an object of the present invention to provide a combination bottle/can beverage cooler and bottle cap opener, comprising a thermal insulated holder having an inner layer and outer layer which serves as a cooler for a beverage bottle/can, wherein the bottom of the inner layer has a double bottle cap opening means including a twist-off cap opener and pry-off cap opener, so that the cap of a capped beverage bottle can be easily removed by using the double bottle cap opening means, and the opened beverage can or the opened beverage bottle can be placed inside of the holder to keep the beverage cold and the users' hands from getting wet or cold.

It is also an object of the present invention to provide a twist-off cap opener comprising an inwardly extending teeth support circular wall which surrounds a round cavity, which is positioned at the center of an inner surface of the bottom member of the holder inner layer. The circular wall includes a circular inner side surface which defines a diameter to match the diameter of a twist-off cap of the beverage bottle. The circular inner side surface of the teeth support circular wall also circumferentially contains teeth means, which enhances engagement to the side surface of the a twist-off bottle cap. With the aid of the twist-off opener, the twist-off bottle cap can be easily twisted to the right or the left to be removed after the holder is turned upside down and placed over the bottle and the cap of the beverage bottle is inserted into the round cavity of the twist-off cap opener.

It is an additional object of the present invention to provide a pry-off cap opener, comprising a rectangular opening throughout the bottom member of the holder inner layer, which is positioned along a diameter of the round void of the twist-off opener. The pry-off opener is further comprised of a contoured lip positioned on the inner surface of the bottom member of the inner layer along each elongated side of the rectangular opening, wherein the lip is contoured in such way as to allow one side of a crown bottle cap to slide into the rectangular opening so that the edge of the crown cap securely rests on the contoured lip. With the aid of the pry-off cap opener, the crown cap of the capped beverage bottle can be easily pried off when the bottle is moved to the right or left.

It is a further object of the present invention to provide a thermal insulated holder having an inner layer and outer layer to act as a combination bottle/can beverage cooler and bottle cap opener, wherein the outer layer is made of soft and flexible plastic and the inner layer is made of hard and heavy-duty plastic so that the holder can serve as a cooler and bottle cap opener, the outer layer of the holder can provide a comfortable feeling when the holder is held, and the double bottle cap opening means on the bottom of the holder inner layer can serve as the bottle cap twist-off opener or pry-off opener.

It is another object of the present invention to provide a thermal insulated holder having an inner layer and outer layer to act as a combination bottle/can beverage cooler and bottle cap opener, wherein the outer layer is made of cloth materials and the short height inner layer is made of hard and heavy-duty plastics so that the holder can be folded to easily fit in the users' clothing pockets.

It is a further object of the present invention to provide a thermal insulated holder having an inner layer and outer layer to serve as a combination bottle/can beverage cooler and bottle cap opener, wherein the outer layer is made of soft and flexible plastic, the inner layer is made of hard and heavy-duty plastic and further including a double bottle cap opening means including a twist-off cap opener and pry-off cap opener is positioned on the inside of the inner layer of the holder so that the cap of a capped beverage bottle can be easily removed with the aid of either the twist-off cap opener or the pry-off cap opener. The opened beverage can or the opened beverage bottle can be placed inside of the holder to keep the beverage cold and protect the users' hands from becoming cold and wet.

Further novel features and other objects of the present invention will become apparent from the following detailed description, discussion and the appended claims, taken in conjunction with the drawings.

BRIEF DESCRIPTION OF THE DRAWINGS

Referring particularly to the drawings for the purpose of illustration only and not limitation, there is illustrated.

DETAILED DESCRIPTION OF THE PREFERRED EMBODIMENTS

Although specific embodiments of the present invention will now be described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention as further defined in the appended claims.

The present invention is a combination bottle/can beverage cooler and bottle cap opener, which is comprised of a thermal insulated holder having an inner layer and outer layer to serve as a cooler for a beverage bottle/can, wherein the bottom of the inner layer is comprised of a double bottle cap opening means. With the aid of the double cap opening means, the cap of a beverage bottle can be conveniently twisted off or pried off. The opened beverage bottle/can then can be placed inside of the holder to keep the beverage cold and protect the users' hands from getting wet or cold.

Figure 1:
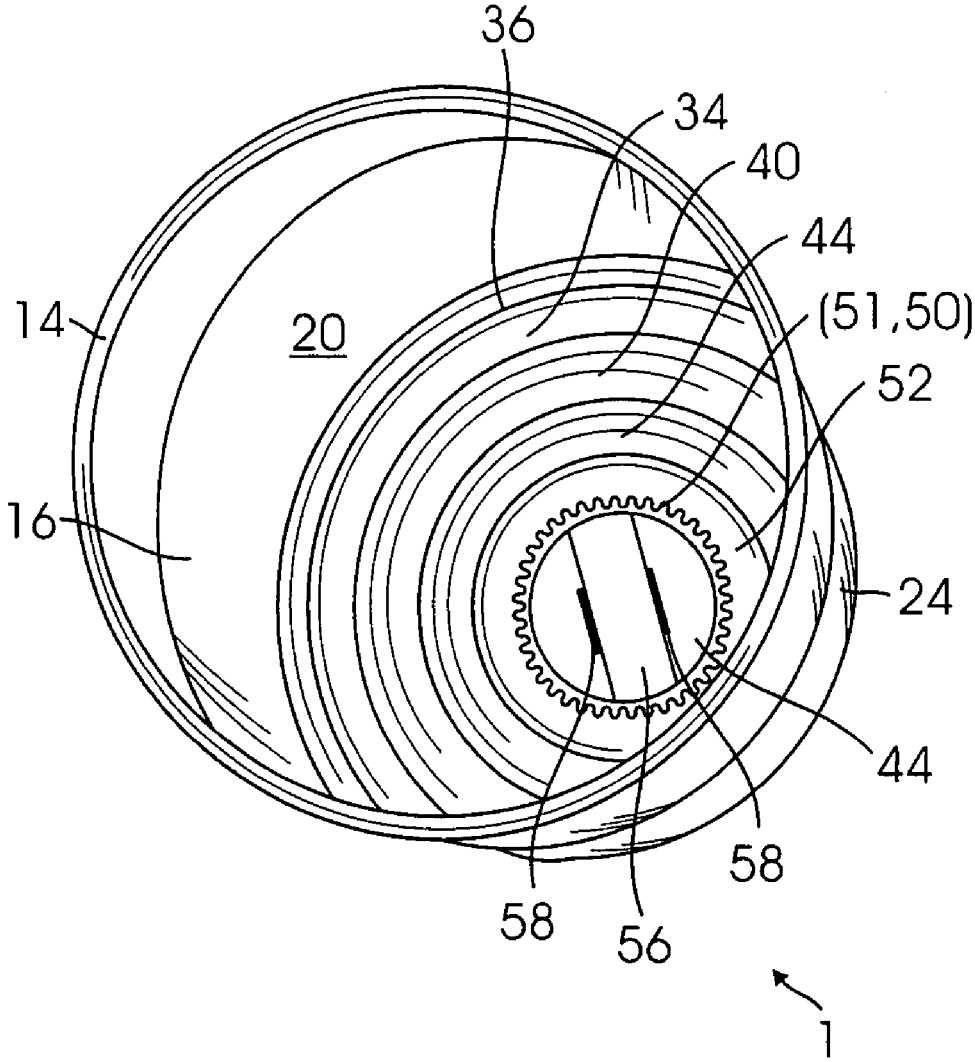
FIG. 1 is a top perspective view of the present invention holder which is serves as a combination bottle/can beverage cooler and bottle cap opener.
Figure 2:
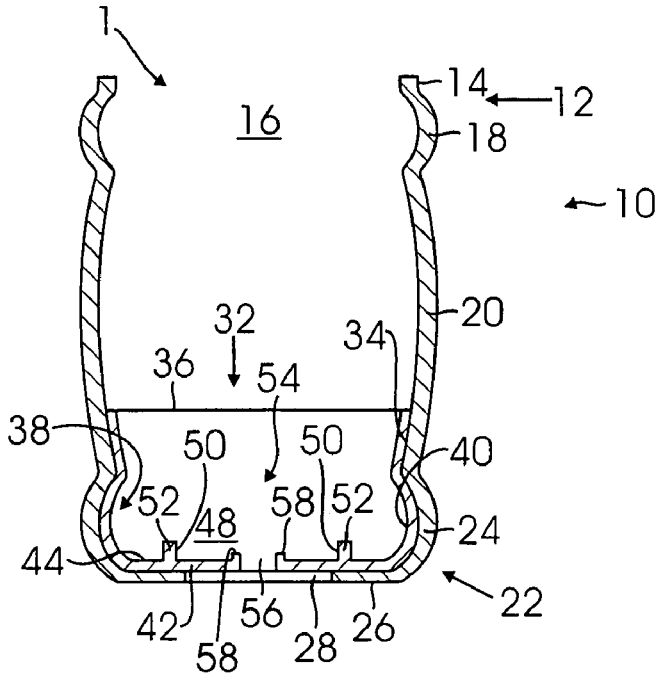
FIG. 2 is a cross-sectional view of the present invention holder which serves as the combination bottle/can beverage cooler and bottle cap opener.

Referring to FIGS. 1 and 2, there is illustrated the present invention holder 1, which functions as a combination bottle/can beverage cooler and bottle cap opener. The holder 1 can be a generally cylindrical shape which comprises an inner layer 32 and an outer layer 10.

The outer layer 10 of the holder 1 is comprised of an upper section 12, a middle section 20 and a lower section 22. The upper section 12 of the outer layer 10 is a circular wall including a top short height cylindrical wall 14 with an opening 16, which is connected to a circular arcuate wall 18. The circular wall 18 is illustrated to be convex in shape when viewed toward the wall 18. The circular middle section 20 is also a circular arcuate wall, which is the longest section of the holder 1, and is also convex in shape. However, the middle section 20 is less arcuate than the upper section 12. In fact, it conforms to the shape of the palm of a users' hand so that users can comfortably grasp the middle section 20 to hold the holder 1. The lower section 22 is comprised of a circularly convex wall 24 having a flat bottom end 26. In addition, a round opening 28 is positioned at the center of the bottom end 26. It will be appreciated that the lower section 22 generally resembles the upper section 12 in shape. The lower section 22 is also relatively shorter, as compared with the middle section 20. Further referring to FIGS. 1 and 2, all three sections 12, 20 and 22 are connected together to form a one piece structure of the outer layer 10 wherein the upper section 12 extends to and is connected to the middle section 20 and the middle section 20 extends to and is connected to the lower section 22.

The inner layer 32 is illustrated in FIGS. 1 and 2 to comprise a top section 34 of a short height circular wall having a top circumference 36, which extends to and is connected to the bottom section 38. The bottom section 38 is comprised of a circular arcuate wall 40, which is connected to a bottom member 42 including an interior surface 44.

It will be appreciated that a unique double bottle cap opening means is positioned at the center of the bottom member 42 of the inner layer 32 for a twist-off cap opener 54 and a pry-off cap opener 56. As best illustrated in FIGS. 1 and 2, the twist-off cap opener 54 is comprised of an inwardly extending teeth supporting circular wall 52 which surrounds a round cavity 48, which is positioned at the center of the inner surface 44 of the bottom member 42. The circular wall 52 includes a circular inner side surface 50 which defines a diameter to match the diameter of a twist-off cap of a beverage bottle. As particularly illustrated in FIG. 1, the circular side surface 50 of the teeth support circular wall 52 also circumferentially contains teeth means 51, which enhances engagement to the side surface of the a twist-off bottle cap when the cap of the beverage bottle is inserted into the round void 48 of the opener 54.

The twist-off bottle cap opener is molded into the interior base of the bottle/can holder. The twist-off cap opener has teeth that grip the outer edge of the a twist-off bottle cap.

The pry-off cap remover is comprised of a rectangular opening 56 throughout the bottom member 42 of the holder inner layer 32, which is positioned along a diameter of the round void 48 of the twist-off cap opener 54. In a preferred embodiment, the rectangular opening 56 is approximately half inch wide and one and a quarter inch long. As further illustrated in FIG. 1, a contoured lip 58 is positioned on the inner surface 44 of the bottom member 42 along each elongated side of the rectangular opening 56, which is contoured in such way as to allow a part of a crown bottle cap to slide in to the rectangular opening 56 so that the edge of the crown cap securely rests on the contoured lip 58.

As illustrated in FIG. 2, the inner layer 32 is substantially shorter than the outer layer 10. The inner layer 32 is also contoured to match the shape of the inner surface of a lower part of the outer layer 10, wherein the lower part includes the bottom section 22 of the outer layer 10, and a part of the middle section 20 of the outer layer 10 which is the part to connect to the bottom circularly convex wall 24 of the bottom section 22. Therefore, the inner layer 32 can be perfectly installed inside of the outer layer 10 to result in a tight contact between the layers 10 and 32.

It will be appreciated that the size of the central opening 28 on the bottom side 26 of the outer layer 10 is sufficiently larger than the size of the rectangular opening 56 of the bottom member 42 of the inner layer 32, so that the rectangular opening 56 which is used as the pry-off cap opener can perform appropriately. It will be further appreciated that the outer layer 10 can be made of soft and flexible plastic materials in non-porous form such as neoprene, or in porous condition such as plastic foam. The outer layer 10 can also be made of cloth materials. If made of cloth material, the holder 1 can be folded thereby to easily fit in the users' clothing pockets. The inner layer 32 is preferably made of a hard plastics, such as the heavy-duty PVC, so that the double bottle cap opening means on the bottom 42 of the inner layer 32 can function appropriately. It will also be appreciated that the holder 1 which is made of the plastic materials can function as the cooler since the plastic materials are good for thermal insulation.

The bottle/can cooler houses both the crown bottle cap opener and the twist-off bottle cap opener in the base of the unit.

The user can open a crown bottle cap by griping the bottle/can cooler and placing it over a bottle's crown cap at a 45 degree angle so that the crown cap's edge rests on the contoured lip of the opening device. By leveraging the bottle/can cooler in either a left or right direction the bottle cap is removed.

The bottle/can cooler can be turned up-side down and placed over the neck of the bottle. The interior twist-off bottle cap remover can then be centered over the twist-off bottle cap so that the bottle cap is secured by the teeth of the interior bottler cap opening device. By holding the bottle securely in one hand, and gripping the exterior base of the bottle/an cooler in the other hand, the bottle/can cooler can be twisted in a left or right direction for the quick removal of twist-off bottle caps.

Figure 3:
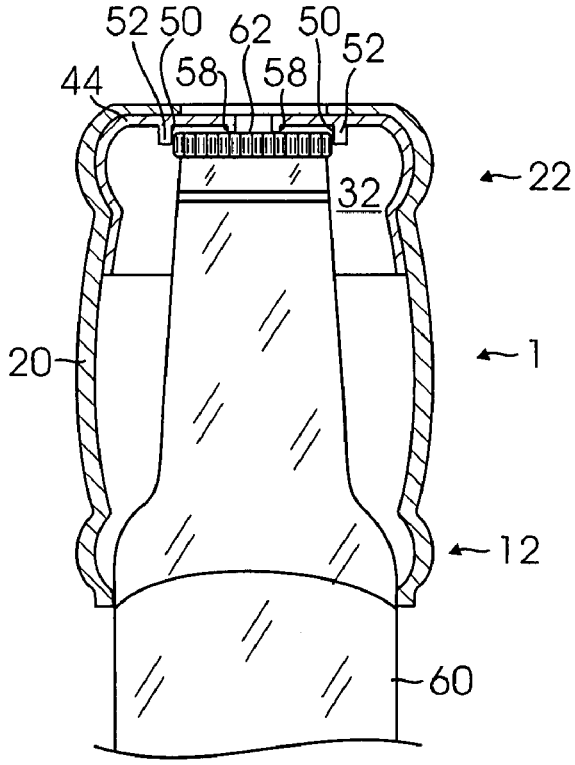
FIG. 3 is a schematic view illustrating the holder being used as a bottle cap opener for a twist-off bottle cap.
Figure 4:
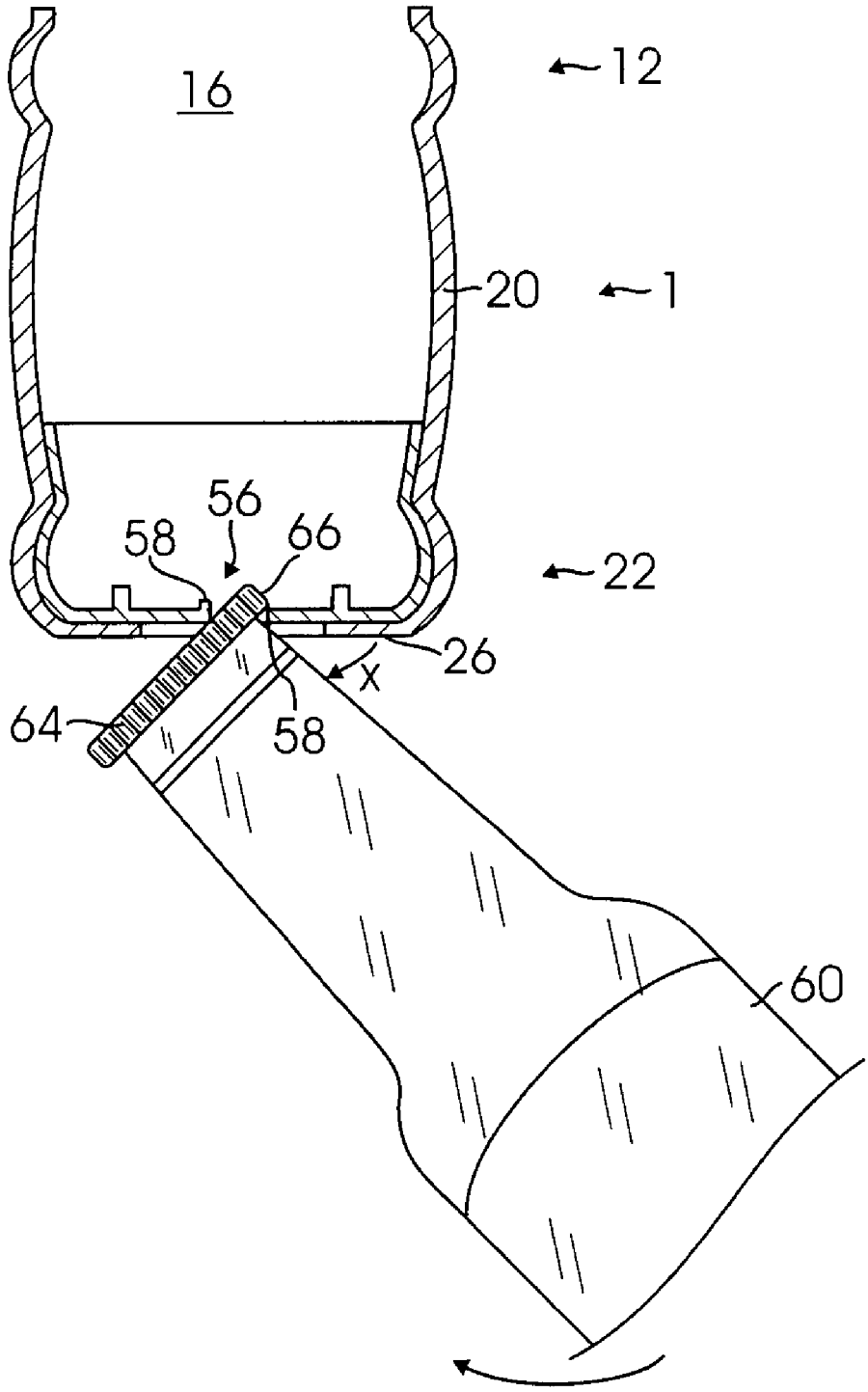
FIG. 4 is a schematic view to illustrating the holder being used as a bottle cap opener to pry-off a crown bottle cap.
Figure 5:
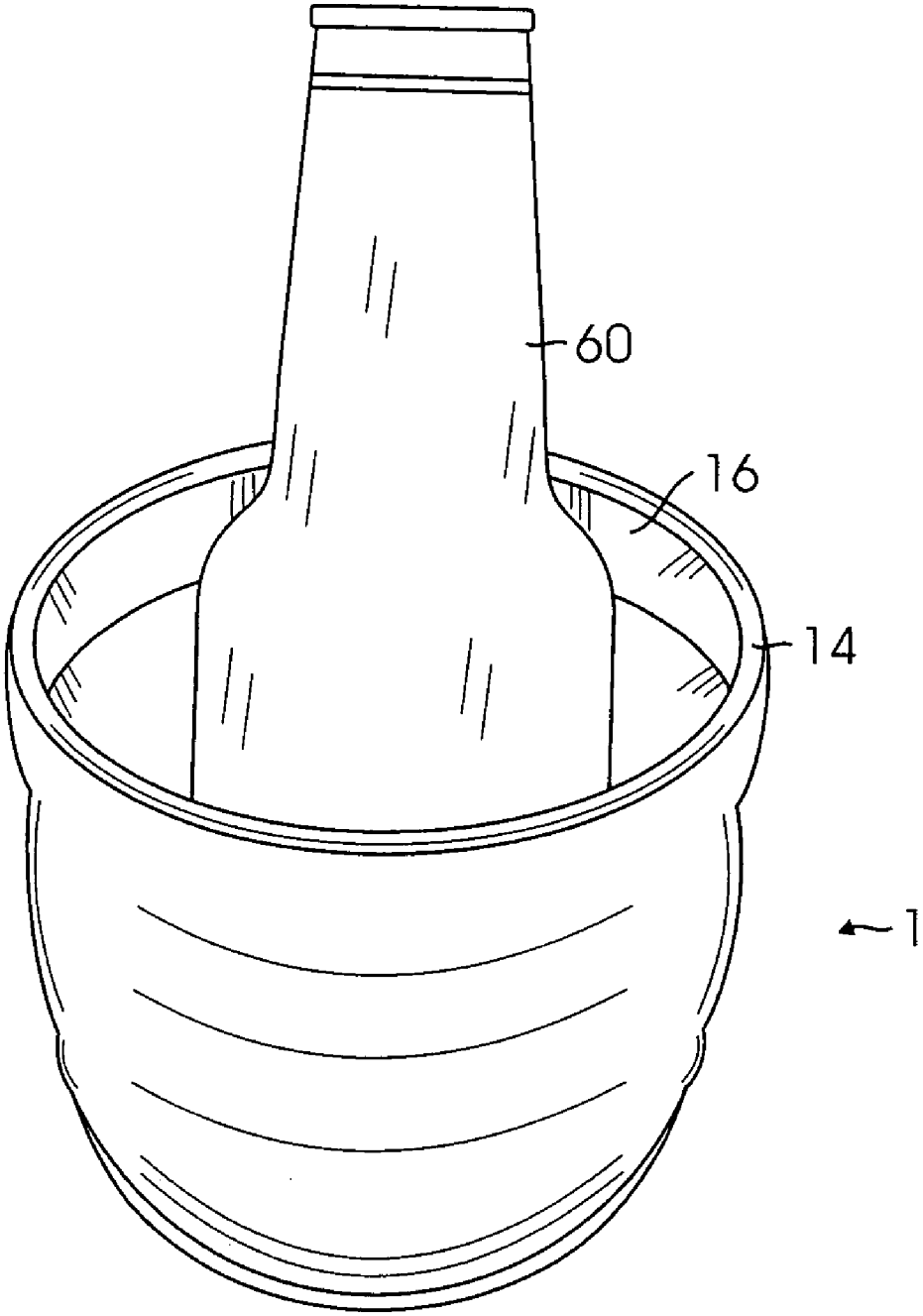
FIG. 5 is a perspective top view illustrating the holder being used as a cooler for a beverage bottle.

Referring to FIGS. 3, 4 and 5, there is illustrated the application of the holder 1, which is used as the respective twist-off cap opener 54, pry-off cap opener 56 and cooler for the beverage bottle/can. As illustrated in FIG. 3, the holder 1 is turned upside down and placed over the bottle 60. In this setting, the bottle cap 62 including the top section of the bottle 60 is inserted through the holder top opening 16 into inside of the holder 1, and the bottle cap 62 is fitted into the cavity 48 of the twist-off cap opener 54 on the holder inner bottom surface 44 of the inner layer 32, wherein the side surface 50 of the twist-off cap opener 54 which is combined with the teeth means 51 enhances engagement to the side surface of the twist-off bottle cap 62. The user can easily twist off the bottle cap 62 with the increased torque, which is provided by the diameter of the respective cylindrical holder 1 and the beverage bottle 60 being larger than the diameter of the cap 62 of the bottle, when the user uses his/her hands to grasp the respective holder 1 and the beverage bottle 60.

FIG. 4 illustrates the application of the holder 1 which is used as the pry-off cap opener 56. In use, the user slides one side of a crown bottle cap 64 into the rectangular opening 56 so that the edge 66 of the crown cap 64 securely rests on the contoured lip 58 of the opener 56, wherein the bottle 60 is held at a preferred angle "X" which can be 45 degrees relative to the bottom side 26 of the holder 1. As illustrated in FIG. 4, the user uses one hand to hold the holder 1 and uses another hand to move the bottle 60 to the left to remove the crown cap 64. It will be appreciated that, alternatively, the crown cap 64 also can be removed when the bottle 60 is moved to the opposite right direction after a part of the cap 64 is slid into the opener 56 wherein the bottle 60 is held 45 degrees to the left of the bottom side 26 of the holder 1. As illustrated in FIG. 5, after the twist-off cap 62 or the pry-off cap 62 is removed, the opened beverage bottle 60 can be placed inside of the holder 1, wherein the holder serves as the cooler so that the user can grasp the holder 1 to keep the beverage cold and protect the user's hands from getting wet and cold.

The above illustrations have disclosed an embodiment of the present invention combination bottle/can beverage cooler and bottle cap opener. However, it will be appreciated that it is within the e spirit and scope of the present invention to encompass numerous variations. For example, the inner layer 32 can also be comprised of three sections to fully contour the shape of the outer layer 10, as compared with the two-section structure of the inner layer 32 shown in FIG. 2. In an opposite way, both the inner and outer layer 32 and 10 of the holder 1 can be simplified as a conventional cup-like having member with only a straight circular section.

While the present invention has been illustrated with a double layer wall, it will be appreciated that the container of the present invention can have a single wall with a transverse bottom end having an inner side such as 44 and an outer side such as 26 with the twist-off bottle cap opener incorporated into the inner side 44 of the bottom section 22 and the pry-open bottle cap opener such as a notch for removing a crown bottle cap incorporated into the outer side 26 of the bottom section 22.

It will be further appreciated that it is within the spirit and scope of the present invention for the double bottle cap opening means including the twist-off cap opener 46 and pry-off cap opener 54 to be positioned at a location which is off-center from the center of the round bottom end of the holder 1. The opening means can be placed at any position of the holder bottom end as long as it can perform appropriately. Following this direction, the double bottle cap means can even be placed on the side wall of the holder 1, instead of be positioned on the bottom end of the holder. In such case, the construction of the double bottle cap opening means is readily understood, therefore, the disclosures will not be repeated. In addition, the slot of the pry-off cap opener 54 is not limited to be rectangular in shape. Any shaped opening means is within the spirit and scope of the present invention, as long as it can function as the pry-off cap opening means.

Although the holder 1 has been illustrated as being a round structure and cup-like, a holder with a non-round shape is also within the spirit and scope of the present invention.

The bottle/can cooler can be made of several materials including but not limited to neoprene, pvc (hard plastic), foam and cloth.

The device can be made to fold so it can easily fit in the user's back pants pocket.

The bottle opener portion can be made of a variety of materials such as metal, PVC, and durable plastic.

The opener could be mounted or molded into the can cooler or placed in another location other than the base of the can cooler, such as either side of the can cooler.

Defined in detail, the present invention is a holder for a beverage container, comprising: (a) an outer layer comprising a circular side wall having an opened top and a bottom end, wherein a round opening extends through the bottom end, an inner layer comprising an upper circular section which is connected to a bottom circular section having a bottom member with an inner surface, wherein a rectangular slot extends through the bottom member, the round opening is larger than the slot, the inner layer is contoured to the outer layer so that the inner layer is installed inside of the outer layer to form the holder, wherein a beverage container can be placed inside of the holder which functions as a beverage cooler; (b) a twist-off bottle cap opener comprising an inwardly extending circular wall to surround a round cavity, which is positioned on the inner surface of the bottom member of the inner layer, wherein the circular wall includes an inner circular inward surface having teeth which matches a diameter of a twist-off cap of a beverage bottle; and (c) a pry-off bottle cap opener comprising the rectangular slot throughout the bottom member of the holder inner layer, which is positioned along a diameter of a round cavity of the twist-off cap opener, the pry-off bottle cap opener is further comprised of a contoured lip which is positioned on the inner surface of the bottom member of the inner layer along each elongated side of the rectangular slot.

Defined more broadly, the present invention is a holder for a beverage container, comprising: (a) an outer layer comprising a circular side wall having an opened top and a bottom end, wherein a round opening extends through the bottom end, an inner layer comprising an upper circular section which is connected to a bottom circular section having a bottom member with an inner surface, wherein a rectangular slot extends through the bottom member, the round opening of the bottom end is larger than the slot of the inner layer, the inner layer is contoured to the outer layer so that the inner layer is installed inside of the outer layer to form the holder, wherein a beverage container can be placed inside of the holder which functions as a beverage cooler; (b) a twist-off bottle cap opener comprising an inwardly extending circular wall having teeth formed therein and which is positioned on the inner surface of the bottom member of the inner layer, the configuration of the inwardly extending circular wall and teeth conforming to a twist off bottle cap; and (c) a pry-off bottle cap opener comprising a rectangular slot throughout the bottom member of the holder inner layer which is positioned along a diameter of a round cavity of the twist-off cap opener, the pry-off bottle cap opener is further comprised of a contoured lip which is positioned on the inner surface of the bottom member of the inner layer along each elongated side of the rectangular slot.

Defined even more broadly, the present invention is a holder for a beverage container, comprising: (a) an outer layer comprising an opened top and a bottom end, wherein an opening extends through the bottom end of the outer layer, an inner layer comprising a bottom member with an inner surface and having an aligned bottom opening which extends through the bottom member, the inner layer is installed inside of the outer layer to form the holder; (b) a twist-off bottle cap opener molded into the opening of the inner surface and having teeth which conform to a twist off bottle cap; and (c) a pry-off bottle cap opener which is aligned within the twist-off cap opener.

Defined the most broadly, the present invention is a holder for a beverage container comprising: (a) a container having an open top, and a sidewall extending to a transverse bottom wall, the bottom wall having an interior base side and an exterior base side; (b) a notch for removing crown bottle caps located on the exterior base side; and (c) a twist-off bottle cap opener located on the interior base side.

Of course the present invention is not intended to be restricted to any particular form or arrangement, or any specific embodiment, or any specific use, disclosed herein, since the same may be modified in various particulars or relations without departing from the spirit or scope of the claimed invention hereinabove shown and described of which the apparatus or method shown is intended only for illustration and disclosure of an operative embodiment and not to show all of the various forms or modifications in which this invention might be embodied or operated.

What is claimed is:

1. A holder for a beverage container, comprising:

a. an outer layer comprising an outer circular wall having an upper section with an opening and a lower section having a flat bottom end, wherein a round opening extends through the bottom end, an inner layer comprising an upper circular section which is connected to a bottom circular section having a bottom member with an inner surface, wherein a rectangular slot extends through the bottom member, the round opening is larger than the slot, the inner layer is contoured to the outer layer so that the inner layer is installed inside of the outer layer to form the holder, wherein a beverage container can be placed inside of the holder which functions as a beverage cooler;

b. a twist-off bottle cap opener comprising an inwardly extending circular wall to surround a round cavity, which is positioned on the inner surface of the bottom member of the inner layer, wherein the circular wall includes an inner circular inward surface having teeth which matches a diameter of a twist-off cap of a beverage bottle; and c. a pry-off bottle cap opener comprising the rectangular slot throughout the bottom member of the holder inner layer, which is positioned along a diameter of a round cavity of the twist-off cap opener, said pry-off bottle cap opener is further comprised of a contoured lip which is positioned on the inner surface of the bottom member of the inner layer along each elongated side of the rectangular slot.

2. The holder in accordance with claim 1 wherein the outer layer is made of material selected from the group consisting of neoprene, hard plastic, foam and cloth.

3. The holder in accordance with claim 1 wherein the inner layer is made of material selected from the group consisting of neoprene, hard plastic, foam and cloth.

4. The holder accordance with claim 1 wherein said twist-off bottle cap opener is made of material selected from the group consisting of metal, PVC and durable plastic.

5. The holder accordance with claim 1 wherein said pry-off bottle cap opener is made of material selected from the group consisting of metal, PVC and durable plastic.

6. A holder for a beverage container, comprising:

a. an outer layer comprising an outer circular wall having an upper section with an opening and a lower section having a flat bottom end, wherein a round opening extends through the bottom end, an inner layer comprising an upper circular section which is connected to a bottom circular section having a bottom member with an inner surface, wherein a rectangular slot extends through the bottom member, the round opening of the bottom end is larger than the slot of the inner layer, the inner layer is contoured to the outer layer so that the inner layer is installed inside of the outer layer to form the holder, wherein a beverage container can be placed inside of the holder which functions as a beverage cooler;

b. a twist-off bottle cap opener comprising an inwardly extending circular wall having teeth formed therein and which is positioned on the inner surface of the bottom member of the inner layer, the configuration of the inwardly extending circular wall and teeth conforming to a twist-off bottle cap; and c. a pry-off bottle cap opener comprising a rectangular slot throughout the bottom member of the holder inner layer which is positioned along a diameter of a round cavity of the twist-off cap opener, said pry-off bottle cap opener is further comprised of a contoured lip which is positioned on the inner surface of the bottom member of the inner layer along each elongated side of the rectangular slot.

7. The holder in accordance with claim 6 wherein the outer layer is made of material selected from the group consisting of neoprene, hard plastic, foam and cloth.

8. The holder in accordance with claim 6 wherein the inner layer is made of material selected from the group consisting of neoprene, hard plastic, foam and cloth.

9. The holder accordance with claim 6 wherein said twist-off bottle cap opener is made of material selected from the group consisting of metal, PVC and durable plastic.

10. The holder accordance with claim 6 wherein said pry-off bottle cap opener is made of material selected from the group consisting of metal, PVC and durable plastic.

11. A holder for a beverage container, comprising:

a. an outer layer comprising an opened top and a bottom end, wherein an opening extends through the bottom end of the outer layer, an inner layer comprising a bottom member with an inner surface and having an aligned bottom opening which extends through the bottom member, the inner layer is installed inside of the outer layer to form the holder;

b. a twist-off bottle cap opener molded into the opening of the inner surface of the bottom member and having teeth which conform to a twist-off bottle cap; and c. a pry-off bottle cap opener which is aligned within the twist-off cap opener and rests within the twist-off opener.

12. The holder in accordance with claim 11 wherein the outer layer is made of material selected from the group consisting of neoprene, hard plastic, foam and cloth.

13. The holder in accordance with claim 11 wherein the inner layer is made of material selected from the group consisting of neoprene, hard plastic, foam and cloth.

14. The holder accordance with claim 11 wherein said twist-off bottle cap opener is made of material selected from the group consisting of metal, PVC and durable plastic.

15. The holder accordance with claim 11 wherein said pry-off bottle cap opener is made of material selected from the group consisting of metal, PVC and durable plastic.

16. A holder for a beverage container comprising:

a. a container having an open top, and a sidewall extending to a transverse bottom wall, the bottom wall having an interior base side and an exterior base side;

b. a notch for removing crown bottle caps located on the exterior base side; and c. a twist-off bottle cap opener located on the interior base side, the notch located within the twist-off bottle can opener.

17. The holder in accordance with claim 16 wherein the notch for removing the crown bottle cap is aligned with the twist-off bottle cap opener.

18. The holder in accordance with claim 16 wherein the container is made of material selected from the group consisting of neoprene, hard plastic, foam and cloth.

19. The holder accordance with claim 16 wherein said twist-off bottle cap opener is made of material selected from the group consisting of metal, PVC and durable plastic.

20. The holder accordance with claim 16 wherein said pry-off bottle cap opener is made of material selected from the group consisting of metal, PVC and durable plastic.

* * * * *